United States Patent [19]

Kowols

[11] Patent Number: 4,490,727

[45] Date of Patent: Dec. 25, 1984

[54] ADJUSTABLE TOP LOADED ANTENNA

[75] Inventor: Gilbert J. Kowols, Park Ridge, Ill.

[73] Assignee: Mobile Mark, Inc., Franklin Park, Ill.

[21] Appl. No.: 85,937

[22] Filed: Oct. 18, 1979

[51] Int. Cl.[3] ..... H01Q 1/36

[52] U.S. Cl. ..... 343/895

[58] Field of Search ..... 343/895, 745, 749, 750, 343/861, 802

[56] References Cited

U.S. PATENT DOCUMENTS

| | | | |
|---|---|---|---|
| 2,487,567 | 11/1949 | Lindenblad | 343/802 |
| 3,611,397 | 9/1969 | Poliakoff | 343/802 |
| 3,798,654 | 3/1974 | Martino et al. | 343/745 |
| 4,161,737 | 7/1979 | Albright | 343/895 |

*Primary Examiner*—Eli Lieberman

*Attorney, Agent, or Firm*—Charles F. Pigott, Jr.

[57] ABSTRACT

An adjustable mobile antenna comprising a dielectric rod several feet in length, a loading coil comprising a conductive wire helically wound in close fashion along an upper portion of the length of the dielectric rod, a protective outer insulator jacket covering the loading coil and a major portion of the dielectric rod, and a dielectric sleeve mounted on the outside of the protective jacket and slidable thereon along the length of the loading coil to effect "dielectric loading" of the loading coil to control the frequency of the antenna.

9 Claims, 11 Drawing Figures

ADJUSTABLE TOP LOADED ANTENNA

BRIEF SUMMARY OF THE INVENTION

The present invention relates to an adjustable mobile antenna for use on automobiles, trucks, boats and the like, and in particular to a top loaded antenna capable of frequency adjustment.

It is known in the art to provide a top loaded antenna, and it is also known to provide an antenna which can be tuned in the field. However, most such tunable antennas are tuned by relatively complex electrical adjusting means, or by means which vary the length of the antenna. An adjustable top loaded antenna which is tuned by varying the antenna length is described in my U.S. Pat. No. 4,152,705, granted May 1, 1979.

It is a general object of the present invention to provide a top loaded antenna having a dielectric sleeve mounted over the outside of the protective insulator jacket on the antenna and located adjacent the upper end thereof for controlling the antenna frequency.

Another object of my invention is to provide a top loaded antenna having on the outside thereof a dielectric sleeve which can be moved along the upper end of the antenna in the area of the upper loading coil whereby the frequency of the antenna can be adjusted by varying the longitudinal position of the sleeve on the upper loading coil.

The foregoing and other objects and advantages of the invention will be apparent from the following description of a preferred embodiment, taken in conjunction with the accompanying drawings.

Now, in order to acquaint those skilled in the art with the manner of making and using my invention, I shall describe, in conjunction with the accompanying drawings, a preferred embodiment of the invention.

DETAILED DESCRIPTION OF THE INVENTION

In the following description, the terms "upper" and "lower" are used with reference to the intended mounting of the antenna in a vertical manner. Thus, the right hand end of the antenna as shown in FIGS. 1–4 will be referred to as the "upper" end of the antenna, and the left hand end as shown in the foregoing drawings will be referred to as the "lower" end of the antenna.

Figure 1:
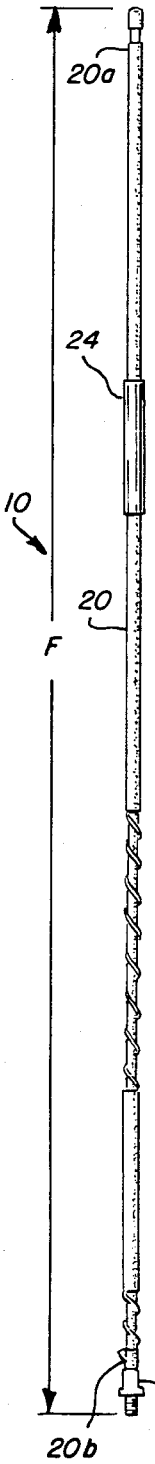
FIG. 1 is an elevational view of a top loaded antenna having an adjustable dielectric sleeve mounted thereon in accordance with the present invention.
Figure 2:
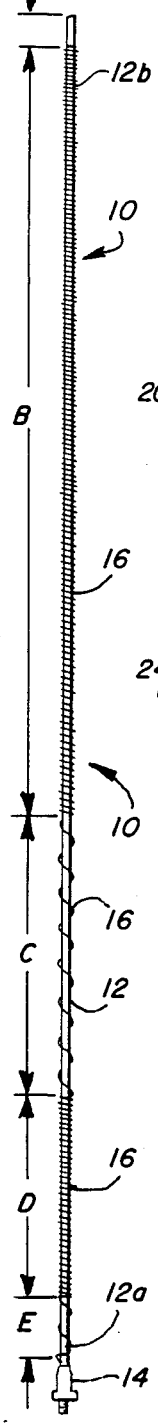
FIG. 2 is an elevational view, partly in section, of the top loaded antenna of FIG. 1 with the dielectric sleeve removed and without the outer protective insulator jacket which covers the entire length of the finished antenna of FIG. 1.

Referring now to the drawings, and in particular to FIGS. 1 and 2, there is shown an antenna 10 comprising a rod 12 (see FIG. 2) made of fiberglass or other dielectric material having a lower end 12*a* which fits into a brass mounting ferrule 14, and an upper end 12*b*. The plated brass mounting ferrule 14, best shown in FIG. 6, comprises an upper tubular portion 14*a*, a tapered body or skirt portion 14*b*, and a threaded lower cylindrical portion 14*c*. The upper tubular portion 14*a* receives the lower end 12*a* of the fiberglass rod which is fixed therein by epoxy glue or other suitable adhesive.

Figure 6:
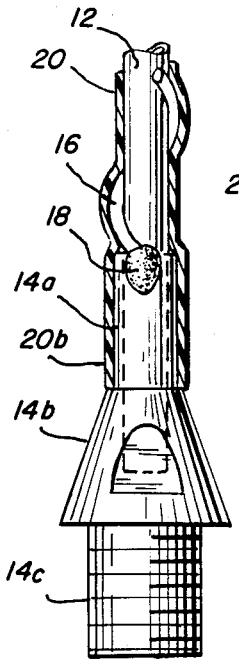
FIG. 6 is a further enlarged fragmentary elevational view, partly in section, showing the lower end of the antenna, including a metal mounting ferrule to which the lower end of the loading coil is electrically connected.

A copper wire 16 is wound on the fiberglass rod 12 beginning approximately one inch from the upper end 12*b* thereof as shown in FIG. 2, the opposite end of the wire being soldered to the brass ferrule 14 as shown at 18 in FIG. 6. The wire 16 is wound at the upper end portion with the turns substantially against one another to provide minimum pitch and thereby achieve the maximum number of turns for a given length of the rod 12. The foregoing closely wound coil is indicated over a length B in FIG. 2 and represents a loading coil which because it is located at the upper end of the antenna provides what is known in the art as a top loaded antenna.

In the particular embodiment described, a second closely wound coil section is provided along a length D of the fiberglass rod 12, whereas the intermediate section along the length indicated at C is not closely wound. However, it is known in the art to provide a top loaded antenna having a closely wound coil section as provided along the length B, and it is also known in the art to provide a second closely wound section as shown along the length D. The second closely wound section at D is not necessary to the present invention. However, the invention does pertain to a top loaded antenna, namely, an antenna having a closely wound coil section adjacent the upper end of the antenna.

In order to protect the coil, an outer jacket 20 of insulating material is provided throughout the length of the antenna. In the preferred embodiment being described, the insulating jacket is made of polyolefin which is heat shrunk on the antenna. In FIG. 1, the polyolefin jacket extends from the upper end as shown at 20*a* to the lower end as shown at 20*b* (see also FIG. 6). Because the protective jacket 20 is tightly shrunk on the antenna as viewed in FIG. 2, the closely wound coil sections along the lengths B and D have a solid appearance in FIG. 1, whereas the loosely wound section along the length C has a different appearance because the configuration of the loosely wound conductive wire 16 is visible through the protective covering. However, it should be understood that the protective jacket 20 extends the full length of the antenna as shown in FIG. 1.

Figure 3:
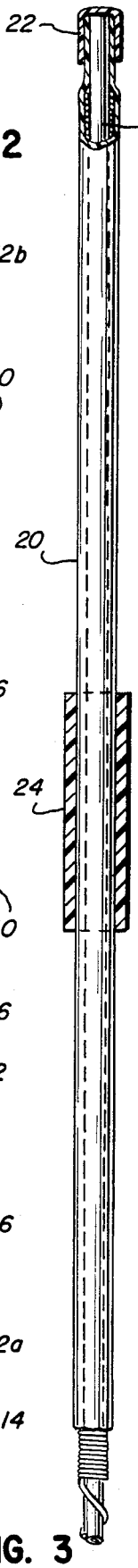
FIG. 3 is an enlarged fragmentary elevational view, partly in section, of the upper portion of the antenna comprising the sections shown at A and B in FIG. 2.
Figure 4:
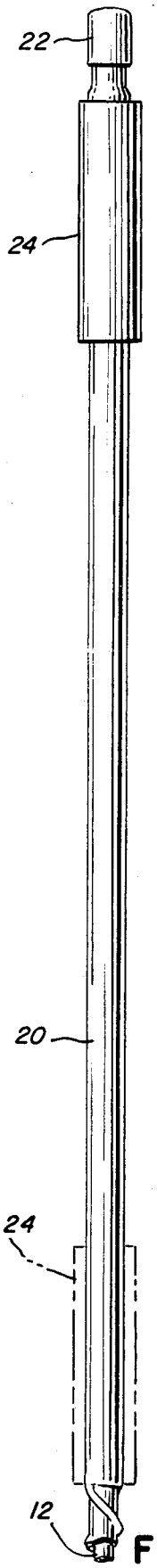
FIG. 4 is a further fragmentary elevational view of the upper portion of the antenna with the adjustable dielectric sleeve shown in solid lines in its upper position near the upper end of the antenna and shown in dash lines near the other end of its intended range of movement where it is located near the lower end of the loading coil.
Figure 5:
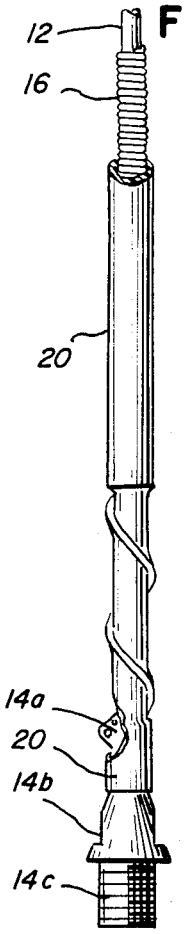
FIG. 5 is a fragmentary elevational view of the lower end portion of the antenna.

As best shown in FIG. 2, the upper section of closely wound conductive coil 16 terminates about one inch before the upper end of the fiberglass rod 12. However, FIG. 3 illustrates the manner in which the protective insulating jacket 20 extends fully to the end of rod 12. In addition, a cap 22 is applied over the upper end of the antenna to protect and seal the antenna. Such a cap is normally about 0.5 inch in length and is known in the art for effecting a protective seal.

The principal feature of the present invention concerns a dielectric sleeve 24 mounted over the protective jacket 20 on the upper end of the antenna for the purpose of controlling the antenna frequency. It is desirable to be able to vary the frequency of a mobile antenna of the type described herein over a range of approximately 0.5 MHz, e.g., between a low frequency of 26.8 MHz and a high frequency of 27.3 MHz. In accordance with the present invention, variation of the antenna frequency is controlled by dielectric loading, namely, the dielectric sleeve 24 which is mounted over the protective jacket 20 and is movable longitudinally on the upper end of the antenna along coil B to vary the frequency.

The sleeve 24 may be made of various dielectric materials, but in accordance with the preferred embodiment it is made of polyvinyl chloride. It will be seen from FIGS. 1, 3 and 4, the length B (see FIG. 2) of the upper loading coil is several times the length of the sleeve 24. By way of example, a typical mobile antenna has an overall length of 3 or 4 feet. For a 3-foot antenna, the length B of the upper loading coil is 20 inches, while for a 4-foot antenna a similar length of 19 inches is utilized.

In conjunction with a length B for the upper loading coil of 19 or 20 inches, the preferred length of the sleeve 24 is about 4.25 inches. It will be understood the length of sleeve 24 may be varied. Nevertheless, for use on a 3 or 4-foot antenna, the sleeve should have a length substantially in excess of one inch in order to provide adequate control of antenna frequency upon longitudinal sliding movement of the sleeve.

In accordance with the present invention, sleeve 24 is produced so as to be somewhat tightly fitted over the outside of protective jacket 20. It must be sufficiently loose that it can be manually moved between the upper position shown in solid lines in FIG. 4 and a lower position generally as shown in dash lines. On the other hand, sleeve 24 must be sufficiently snug that it will remain in any longitudinal position in which it is placed and will not accidentally shift position to avoid any unintentional change in antenna frequency.

As indicated above, a typical mobile antenna may be 3 or 4 feet in overall length and have an upper loading coil of a length B on the order of 19 or 20 inches, with sleeve 24 being of a length of approximately 4.25 inches. Movement of the dielectric sleeve 24 over the length B will effect a variation in the antenna frequency of approximately 0.5 MHz (megahertz), as for example from a minimum frequency of 26.8 MHz to a maximum of 27.3 MHz. The raising of the sleeve 24 to its uppermost position at the top of the upper loading coil B as shown in solid lines in FIG. 4 produces the minimum antenna frequency. Thus, as sleeve 24 is moved closer to the top or voltage end of the antenna, the sleeve loads the antenna more and effects lowering of antenna frequency. As sleeve 24 is lowered toward the position shown in dash lines in FIG. 4, frequency is increased. When sleeve 24 is moved just below the lower end of the upper coil B, i.e., just below the length B shown in FIG. 2, maximum antenna frequency is achieved and no effect is produced by further lowering of the sleeve on the body of the antenna.

It will further be noted that the tuning effect of the dielectric sleeve 24 is greatest at the upper end of the length B of the upper coil. That is, when the sleeve 24 is near the upper end of its range of movement as shown in solid lines in FIG. 4, an incremental movement of the sleeve produces a greater change in antenna frequency than when the sleeve is located near the lower end of the length B of the upper coil as shown in dash lines in FIG. 4.

Figure 7:
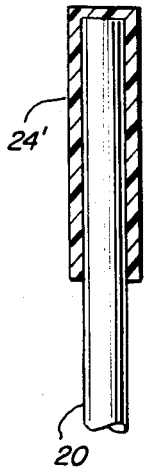
FIG. 7 is a fragmentary elevational view, partly in section, showing the upper end of an alternative embodiment of the antenna where an adjustable dielectric sleeve is closed at one end, the closed sleeve being shown in its lowermost position on the antenna body.
Figure 8:
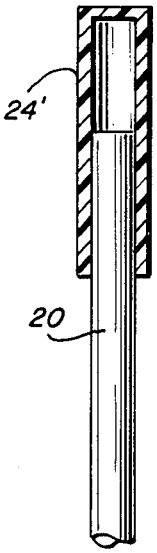
FIG. 8 is a view similar to FIG. 7 showing the closed sleeve moved upwardly to a raised position for purposes of adjusting the antenna frequency.

FIGS. 7 and 8 illustrate a somewhat different form of sleeve 24′ where only the lower end of the sleeve is open and the upper end is closed. Accordingly, in the embodiment of FIGS. 7 and 8 the sleeve is more in the nature of a cap. However, it should be understood a conventional end cap for an antenna is only 0.5 inch in length, and such a cap is not used for the purpose of controlling antenna frequency but only to provide a protecting seal for the upper end of the antenna. In accordance with the present invention, sleeve 24′ is at least 1.5 inches in length, and in order to achieve adjustment of antenna frequency, the sleeve is slidable on the protective jacket 20 between different longitudinal positions as shown for example in FIG. 8.

Figure 9A:
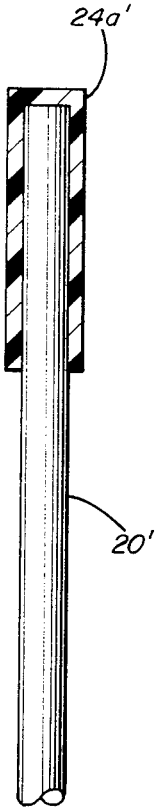
FIGS. 9*a*, 9*b* and 9*c* show a plurality of dielectric sleeves of the type shown in FIGS. 7 and 8 but made in different lengths so that a selected one may be utilized to achieve a desired antenna frequency.
Figure 9B:
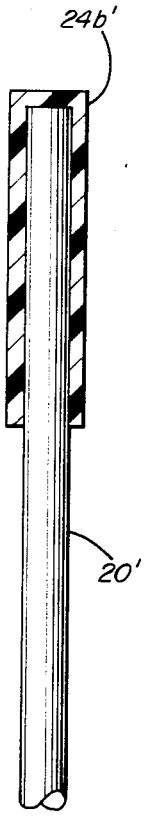
Figure 9C:
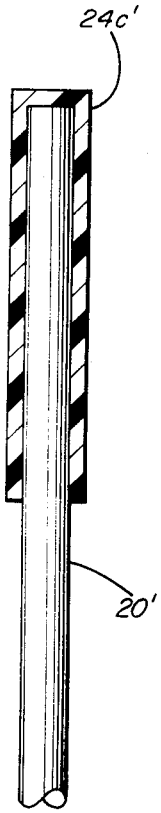

If desired, one can supply an antenna with more than one sleeve 24′ of different lengths as shown at 24*a*′, 24*b*′ and 24*c*′ in FIGS. 9*a*, 9*b* and 9*c*. In the latter case, the antenna frequency can be adjusted by removing one sleeve 24′ and substituting one of a different length, and in each case the sleeve 24′ could be positioned in its lowermost position as shown in FIG. 7. For example, if the antenna were provided with a 1.5 inch sleeve mounted in the position shown in FIG. 7, and it was desired to reduce the antenna frequency, the frequency reduction could be achieved by removing the 1.5 inch sleeve and mounting a longer sleeve such as a 3 inch sleeve in the position shown in FIG. 7. Nevertheless, it will be understood that for fine adjustments of antenna frequency, it is necessary to provide a sleeve which can be longitudinally adjusted to different positions along the length B of the upper coil.

Referring further to the dimensions of a 3 or 4-foot mobile antenna of the type described herein, the dimensions in inches may be approximately as follows:

| | 3 feet | 4 feet |
|---|---|---|
| A | 1″ | 1″ |
| B | 20″ | 19″ |
| C | 8.5″ | 22″ |
| D | 4.12″ | 3.87″ |
| E | 1.87″ | 1.87″ |
| F | 36″ | 48″ |

It will be understood from the foregoing that the present invention concerns the frequency of a mobile top loaded antenna by use of a dielectric sleeve which mounts over the outside of the protective insulator jacket of the antenna. In accordance with one preferred embodiment, the dielectric sleeve is open at both ends and is slidable longitudinally along an upper loading coil at the upper end of the antenna for the purpose of electrically tuning the antenna. Movement of the sleeve upward toward the top end where the voltage is highest has the effect of reducing antenna frequency, while movement of the sleeve downwardly toward the lower end of the loading coil where voltage is lower and current is higher has the effect of raising antenna frequency.

In accordance with a second embodiment, the sleeve may be closed at its upper end in the manner of a cap, but such a closed sleeve is preferably well in excess of one inch in length and is made longitudinally slidable to different positions on the antenna.

In accordance with still another embodiment, sleeves of the latter type which are closed at their upper ends may be supplied in several lengths, whereby a dielectric sleeve of a given length may be selected in order to achieve a desired antenna frequency. A longer sleeve is selected to achieve a lesser frequency.

It is also possible to supply a relatively long sleeve of the foregoing type which is closed at its upper end, with the intent of trimming down the length of the sleeve in the field in order to raise the frequency to a desired level.

What is claimed is:

1. A mobile antenna of the type having a dielectric rod on which conductive wire is helically wound to form a close wound loading coil along a portion of the length of the dielectric rod adjacent the upper end thereof, and a protective outer jacket of insulating material covering the loading coil and extending along at least the major portion of the length of the dielectric rod, the improvement comprising, a dielectric sleeve mounted over said protective jacket on the upper end thereof, said dielectric sleeve being snugly mounted over said jacket but being slidable along said loading coil to adjust the antenna frequency.

2. A mobile antenna as defined in claim 1 where said dielectric sleeve is at least one inch in length.

3. A mobile antenna as defined in claim 1 where said dielectric sleeve is open at both ends and is slidable from the upper end of said loading coil to a position at the lower end of said loading coil.

4. A mobile antenna as defined in claim 1 where said dielectric sleeve is made of polyvinyl chloride.

5. A mobile antenna as defined in claim 1 where the length of said upper loading coil is at least approximately 15 inches and the length of said dielectric sleeve is at least approximately 2.5 inches.

6. A mobile antenna of the type having a dielectric rod on which conductive wire is helically wound to form a close wound loading coil along at least approximately 15 inches of the length of the dielectric rod adjacent the upper end thereof, and a protective outer jacket of insulating material covering the loading coil and extending along at least the major portion of the length of the dielectric rod, the improvement comprising, a dielectric sleeve at least approximately 2.5 inches in length mounted over said protective jacket on the upper end thereof, said dielectric sleeve being open at both ends and being snugly mounted over said jacket and slidable along said loading coil to adjust antenna frequency, and said sleeve being slidable from the upper end of said loading coil to a position at the lower end of said loading coil.

7. A mobile antenna as defined in claim 1 where said dielectric sleeve is closed at its upper end and is at least 1.5 inches in length.

8. A mobile antenna of the type having a dielectric rod on which conductive wire is helically wound to form a close wound loading coil along a portion of the length of the dielectric rod adjacent the upper end thereof, and a protective outer jacket of insulating material covering the loading coil and extending along at least the major portion of the length of the dielectric rod, the improvement comprising, a plurality of dielectric sleeves one of which is selected for mounting over said protective jacket on the upper end thereof, each dielectric sleeve being closed at its upper end, at least one of said dielectric sleeves being at least 1.5 inches in length, and a selected one of said dielectric sleeves being mounted on the upper end of said protective jacket depending upon the desired frequency of said antenna, the lower the desired frequency the greater the length of dielectric sleeve selected for mounting on the upper end of said protective jacket.

9. A mobile antenna in accordance with claims 6 or 8 where said dielectric sleeve is made of polyvinyl chloride.

* * * * *